United States Patent [19]

Harder et al.

[11] Patent Number: 4,865,956

[45] Date of Patent: Sep. 12, 1989

[54] PHOTOGRAPHIC ELEMENTS CONTAINING A BLEACH ACCELERATOR PRECURSOR

[75] Inventors: John W. Harder, Rochester; Stephen P. Singer, Spencerport, both of N.Y.

[73] Assignee: Eastman Kodak Company, Rochester, N.Y.

[21] Appl. No.: 270,922

[22] Filed: Nov. 14, 1988

Related U.S. Application Data

[63] Continuation-in-part of Ser. No. 124,730, Nov. 24, 1987, abandoned.

[51] Int. Cl.[4] ..... G03C 5/44

[52] U.S. Cl. ..... 430/430; 430/393; 430/429; 430/445; 430/460; 430/461; 430/487; 430/542; 430/620

[58] Field of Search ..... 430/393, 429, 430, 445, 430/460, 461, 487, 542, 620

[56] References Cited

U.S. PATENT DOCUMENTS

| | | | |
|---|---|---|---|
| 3,893,858 | 7/1975 | Wabnitz, Jr. | 96/60 |
| 4,163,669 | 8/1979 | Kanada et al. | 96/60 |
| 4,524,129 | 6/1985 | Kishimoto et al. | 430/393 |
| 4,596,764 | 6/1986 | Ishimaru | 430/393 |
| 4,695,529 | 9/1987 | Abe et al. | 430/351 |
| 4,780,403 | 10/1988 | Kishimoto et al. | 430/430 |

*Primary Examiner*—Paul R. Michl
*Assistant Examiner*—Hoa Van Le
*Attorney, Agent, or Firm*—Joshua G. Levitt

[57] ABSTRACT

Silver halide photographic elements are described containing, as a bleach accelerator precursor, a silver salt of a solubilized, non-primary amino thiol. The bleach accelerators are operable with a multiplicity of bleach compositions and do not deleteriously affect the sensitometric properties of the photographic element.

14 Claims, No Drawings

PHOTOGRAPHIC ELEMENTS CONTAINING A BLEACH ACCELERATOR PRECURSOR

This a continuation-in-part of U.S. application Ser. No. 124,730, filed November 24, 1987, now abandoned.

FIELD OF THE INVENTION

This invention relates to color photographic materials. In a particular aspect it relates to color photographic materials containing bleach accelerator precursors.

BACKGROUND OF THE INVENTION

A color image is formed in a color photographic element by generation of an imagewise distribution of the dye as a function of silver halide development. Typically dye is formed by reaction between a coupler compound and oxidized silver halide developing agent. However, dye images can also be formed by other means such as the imagewise diffusion of dye or the imagewise destruction of dye. Regardless of the means by which the dye image is formed, it is common practice to remove the silver image formed on development and silver halide remaining in unexposed areas of the element. This is accomplished by a bleaching step in which the silver image is oxidized by a suitable oxidizing agent, commonly referred to as a bleaching agent, following by dissolving the silver halide in a silver halide solvent, commonly referred to as a fixing agent. Alternatively, the bleaching agent and the fixing agent can be combined in a bleach-fixing solution and the silver removed in one step by the use of such a solution.

A variety of bleach compositions have been employed with silver halide materials. These include those based on, i.e., ferricyanide, dichromate, permanganate, chloride, quinone, as well as amino carboxylic acid and persulfate oxidizing agents. Typical compositions containing such oxidizing agents for the bleaching of photographic image silver are referred to or described in U.S. Pat. Nos. 3,512,979; 3,615,513; 3,647,469; 3,689,272; 3,706,561; 3,716,362; 3,749,572; 3,772,020; 3,893,858; 4,163,669; 4,292,401; 4,293,639; 4,301,236; 4,322,493; 4,448,878; 4,458,010; 4,481,290; 4,524,129; 4,546,070; and 4,596,764.

Other descriptions of the composition and use of photographic silver bleaches are found on pages 124 and 125 of Neblettes's Handbook of PHOTOGRAPHY AND REPROGRAPHY, Materials, Processes and Systems, Seventh Edition, Van Nostrand Reinhold Company; and on pages 447 to 450 of THE THEORY OF THE PHOTOGRAPHIC PROCESS, Fourth Edition, MacMillan Publishing Co., Inc., Hew York, London.

Various substituted thiols have been found to accelerate bleaching either when directly added to the bleach solution, or, if introduced via a prebath, before the bleaching step. See for example U.S. Pat. No. 3,893,858, issued July 8, 1975.

U.S. Pat. No. 4,163,669, issued Aug. 7, 1979, suggest that there would be an advantege to incorporating the bleach accelerator directly in the photographic film but that incorporation of the free thiol would have adverse effects on the photographic properties of the film. The '669 patent suggests incorporating in a photographic element certain bleach accelerators as the salt of a heavy metal ion. Among the bleach accelerators mentioned are the organic thiols of the type described in U.S. Patent 3,893,858.

While the heavy metal salts described in the '669 patent are effective with bleach compositions based on ferric EDTA, they are not as effective with other bleach compositions, such as persulfate bleaches, as would be desired. Furthermore, while they give good sensitometric results with freshly coated photographic elements, upon prolonged keeping they have a deleterious effect on the sensitometric properties of the material.

Accordingly it would be desirable to have bleach accelerator precursor compounds which can be incorporated in a photographic film without adversely affecting the sensitometric properties of the film upon long term keeping and which will permit the film to be used in a multiplicity of bleach and bleach fix compositions with good results.

SUMMARY OF THE INVENTION

We have found compounds which can be incorporated in photographic elements as novel bleach accelerator precursors. These compounds do not have an adverse sensitometric effect on the photographic element and are effective with a variety of bleach and bleach-fix compositions.

In one embodiment our invention is a silver halide color photographic element comprising a support, a silver halide emulsion layer, and a bleach accelerator precursor wherein the bleach accelerator precursor is a silver salt of a solubilized, non-primary amino thiol, the precursor having a solubility of less than 1 g/1 silver ion, in a color developer solution comprising a pH of 10, a sulfite concentration of 4.25 g/1 and a bromide concentration of 1.3 g/1, and a solubility of greater than or equal to 1 g/1 silver ion in a bleach solution having a pH of 6 and a bromide ion concentration of 150 g/1, when held at 23° C. for five minutes in each of the solutions.

Preferred compounds are solubilized by one or more ether or thioether groups or by an additional non-primary amino group. Especially preferred are those compounds solubilized with either groups.

Preferred heavy metal salt bleach accelerator precursors of the invention have a relatively low solubility in the alkaline developer solution in which the element is processed and a relatively high solubility in the acidic bleach or bleach-fix solution in which the element is processed.

As used herein, solubility is defined as grams per liter of silver ion in solution when the test compound is treated as follows: 0.4 g of the test precursor is mixed with 10 ml of the developer or bleach used in Process A, infra. The mixture is stirred for 30 seconds and held at 23° C. Five minutes after mixing a 20 μl aliquot is withdrawn, treated with cyanogeniodate to complex silver ion in solution and the silver ion present is measured by atomic adsorption spectroscopy.

Compounds useful in this invention are silver salts. However, salts of other heavy metals, such as iron, cobalt, nickel, copper, zinc, rhodium, palladium, cadium, iridium, platinum, gold, and lead ions, are expected to give equivalent results.

Representative precursor compounds useful in this invention are structurally shown below:

TABLE 1

| | |
|---|---|
| 1. | 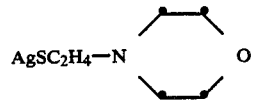 |
| 2. | 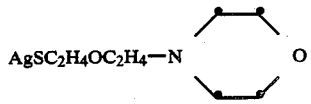 |
| 3. | 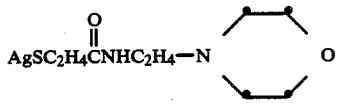 |
| 4 | 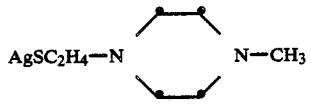 |
| 5. | $AgSC_2H_4OC_2H_4N(CH_3)_2$ |
| 6. | $AgSC_2H_4N(C_2H_4OCH_3)_2$ |

By employing such a bleach accelerator precursor in a photographic element, reductions in residual silver levels—that is, silver levels still present following bleaching—can be achieved. With reduced residual silver, contrast is decreased and image quality and color saturation are improved. Additionally the infrared density of the photographic element contributed by the residual silver can be reduced, which is advantageous when infrared absorbing features such as sound tracks and control markings form a part of the photographic element. As an alternative to lowering residual silver levels an advantage can be realized in shortening the the bleaching step, if desired.

The bleach accelerator precursors of the present invention are advantageously employed with photographic elements which contain dye adsorbed to developable silver halide surfaces. They are particularly advantageous with photographic elements containing high levels of sensitizing dye, such as spectrally sensitized high aspect ratio tabular grain emulsions, as described in *Research Disclosure,* January 1983, Item 22543, published by Emsworth Studies Inc., New York, N.Y.

One or more bleach accelerator precursors of the invention can be located in the photographic element at any convenient location capable of permitting diffusion of the released active fragment to a silver containing emulsion layer during bleaching. Thus the compound can be incorporated directly in the silver halide emulsion layer from which silver is to be bleached, or alternatively in any other bleach solution permeable layer of the photographic element on either side of the support, particularly any layer adjacent the emulsion layer from which silver is to be bleached. The bleaching of silver from the usually lowermost red-sensitized emulsion layer in a color photographic element can be enhanced by incorporation of the accelerator precursor in an underlying antihalation layer.

The bleach accelerator precursor compounds of the present invention can be incorporated in the photographic element by a variety of techniques. Especially preferred techniques include homogenizing or ball milling a slurry of the compound in the presence of a surfactant to form finely divided particles, as disclosed in Swank et al U.S. Pat. No. 4,006,025; milling a mixture of molten compound and a molten or liquid dispersing agent, as described in British Patent No. 1,151,590; or mechanically dispersing the compound, as described in Belgian Patent No. 852,138. Ultrasound can be employed to dissolve the compound prior to its incorporation in the photographic coating composition, as illustrated by Owen et al. U.S. Pat. No. 3,485,634 and Salmien U.S. Pat. No. 3,551,157. Alternatively, the compound can be dispersed directly in a hydrophilic colloid such as gelatin; or the compound can be loaded into a latex and dispersed, as illustrated by Chen Research Disclosure, Vol. 159 July 1977, Item 15930.

Exemplary apparatus and procedures for introducing and blending the bleach accelerator compound according to this invention are illustrated by Johnson et al U.S. Pat. Nos. 3,425,835; 3,570,818; 3,773,302 and 3,850,643; McCrossen et al U.S. Pat. No. 3,342,605, Collins et al U.S. Pat. No. 2,912,343 and Terwilliger et al U.S. Pat. Nos. 3,827,888 and 3,888,465.

The bleach accelerator precursors are incorporated in a photographic element, such as an otherwise conventional color photographic element, preferably at levels in the range of from 0.01 to 10 $g/m^2$, with levels of from 0.05 to 0.15 $g/m^2$ being optimum for ordinarily encountered silver levels. For photographic elements having elevated silver levels still higher levels of the compounds may be desirable.

In its preferred application this invention is directed to bleaching silver from photographic elements capable of producing multicolor dye images. Such photographic elements are typically comprises of a support having coated thereon a plurality of color forming layer units. The color forming layer units include at least one blue recording yellow dye image forming layer unit, at least one green recording magenta dye image forming layer unit, and at least one red recording cyan dye image forming layer unit. Each color forming layer unit includes at least one silver halide emulsion layer. A dye image providing material such as a coupler can be located in the emulsion layer, in an adjacent layer, or introduced during development. The emulsion layer or layers in the blue recording layer unit can rely on native sensitivity to blue light or contain adsorbed to the silver halide grains of the emulsion a dye capable of absorbing blue light, i.e. a blue sensitizing dye. Sensitizing dyes capable of absorbing green and red light are adsorbed to silver halide grain surfaces in the emulsion layers of the green and red recording color forming layer units, respectively.

To prevent color contamination of adjacent color forming layer units, oxidized development product scavengers can be incorporated at any location in the color forming layer units or an interlayer separating the adjacent color forming layers units. Useful scavengers include alkyl substituted aminophenols and hydroquinones, as disclosed by Weissberger et al U.S. Pat. No. 2,336,327 and Yutzy et al U.S. Pat. No. 2,937,086, sulfoalkyl substituted hydroquinones, as illustrated by Thirtle et al U.S. Pat. No. 2,701,197, and sulfonamido substituted phenols, as illustrated by Erikson et al U.S. Pat. No. 4,205,987.

Any conventional silver halide emulsion containing a dye adsorbed to the surface of the silver halide grains can be employed. For color print applications silver chloride, silver bromide and silver chlorobromide emulsions are particularly contemplated, while for camera speed photography silver bromoiodide emulsions are preferred. The silver halide emulsions can be direct positive emulsions, such as internal latent image emulsions, but are in most applications negative-working. Illustrative silver halide emulsion types and preparations are disclosed in *Research Disclosure,* Vol. 176, December 1978, Item 17643, Paragraph I. Particularly preferred silver halide emulsions are high aspect ratio tabular grain emulsions, such as those described in *Research Disclosure,* Item 22534, cited above.

Illustrative dyes usefully adsorbed to silver halide grain surfaces are those dyes commonly employed to alter the native sensitivity, extend the spectral sensitivity, or to perform both functions in silver halide emulsions, often collectively referred to as spectral sensitizing dyes. Such adsorbed dyes can be chosen from a variety of classes, including the polymethine dye class, which includes the cyanines, merocyanines, complex cyanines and merocyanines, oxonols, hemioxonols, styryls, merostyryls and streptocyanines.

For a more detailed discussion of the use of spectral sensitizing dyes in color photographic materials, reference is made to *Research Disclosure,* December 1978, Item 17643, Paragraph IV.

Although it has been specifically recognized that dyes adsorbed to silver halide grain surfaces can inhibit the bleaching of silver developed in photographic materials, it is believed that similar inhibition of bleaching can be imparted by other adsorbed addenda. Therefore the advantages of the disclosed invention with bleaching from photographic elements of silver produced by development of silver halide having adsorbed addenda other than dyes.

The photographic elements can be comprised of any conventional photographic support. Typical photographic supports include polymer film, wood fiber—e.g., paper, metallic sheet and foil, glass and ceramic supporting elements provided with one or more subbing layers to enhance the adhesive, antistatic, dimensional, abrasive, hardness, frictional, antihaltion, or other properties of the support surfaces. Typical useful supports are further disclosed in *Research Disclosure,* Item 17643, December 1978, Paragraph XVII.

In addition to features described above the photographic element can, of course, contain other conventional features known in the art, which can be illustrated by reference to *Research Disclosure,* Item 17643, cited above. For example, the silver halide emulsions can be chemically sensitized, as described in Paragraph III; contain brighteners, as described in Paragraph V; contain antifoggants and stabilizers, as described in Paragraph VI; absorbing and scattering materials, as described in Paragraph III; the emulsion and other layers can contain vehicles, as described in Paragraph IX; the hydrophilic colloid and other hydrophilic colloid layers can contain hardeners, as described in Paragraph X; the layers can contain coating aids, as described in Paragraph XI; the layers can contain plasicizers and lubricants, as described in Paragraph XII; and the layers, particularly the layers farthest from the support, can contain matting agents, as described in Paragraph XVI. This exemplary listing of addenda and features is not intended to restrict or imply the absence of other conventional photographic features compatible with the practice of the invention.

Exposed photographic elements of the invention can be processed by any conventional technique of producing a dye image, whereafter the concurrently developed silver image is removed by bleaching or bleach-fixing. Residual, undeveloped silver halide can be removed in a separate fixing step or concurrently with bleaching. A separate pH lowering solution, referred to as a stop bath, may be employed to terminate development prior to bleaching. A stabilizer bath can be employed prior to drying. Conventional techniques for processing are illustrated by *Research Disclosure,* Item 17643, Paragraph XIX.

Although the invention has been described in terms of employing one or more compounds to enhance bleaching, it is appreciated that other, compatible compounds for enhancing bleaching can, if desired, be employed in combination. Such other compounds may be present in the photographic element or a processing solution.

The bleach accelerator precursor compounds according to this invention can be prepared by procedures generally known in the art. The following provide illustrations of preferred compounds syntheses.

The starting thiol material can be prepared by the method disclosed by D. D. Reynolds et al. in *Journal of Organic Chemistry,* Vol. 26, pages 5109–5126 (1961). After reaction of the thiol with a water-soluble salt such as silver nitrate, the compound is purified to remove reaction products that might have an adverse effect on the sensitometric properties of the silver halide emulsion.

PREPARATION OF PRECURSOR NO. 1

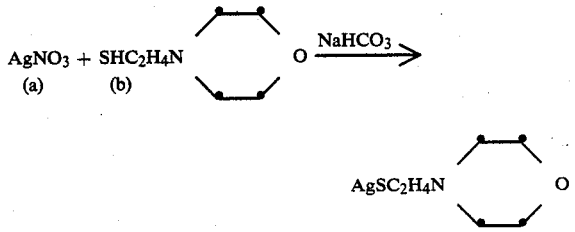

200 ml of a 5 molar silver nitrate solution (1) were added dropwise to 147 g (1 mole) of the morpholinoethanethiol (b) contained in a 1-liter Erlenmeyer flask resting in an ice/acetone bath for maintaining a temperature of about 20° C. The mixture was stirred for 2 hours, then cooled to 10° C. and filtered. The wet solid residue was placed ina 4-liter container and continuously neutralized with a saturated $NaHCO_3$ solution for 3 hours with stirring. The solid was collected and then washed sequentially with water, ethanol and diethyl ether, and finally dried in a vacuum oven at room temperature.

Yield: 150 g of an off-white solid.

| Analysis | Found | Theor. |
|---|---|---|
| N | 5.4 | 5.5 |
| C | 27.6 | 28.4 |
| H | 4.4 | 4.8 |
| S | 12.1 | 12.6 |

Other compounds according to the invention were prepared anagolously.

EXAMPLES

The following examples further illustrate this invention. In these examples the bleach accelerator precursors of the invention and the comparison bleach accelerator precursors, have the structures shown below. Where available solubilities, measured as described above, are provided:

| COMPOUND | STRUCTURE | SOLUBILITY IN DEVELOPER | SOLUBILITY IN BLEACH |
|---|---|---|---|
| Inventive compound 1 | 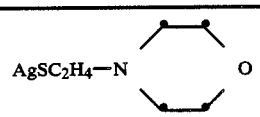 | 0.1 | 2.1 |
| Inventive compound 3 | 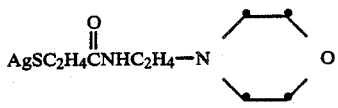 | not measured | |
| Inventive Compound 4 | 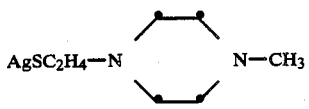 | 0.3 | 11.8 |
| Comparison compound A | $AgSC_2H_4N(CH_3)_2$ | 0.2 | 0.2 |
| Comparison compound B | $AgSC_2H_4NH_2$ | 0.4 | 0.2 |

EXAMPLE 1 Bleach Performance

A first, control, photographic element was prepared having the following structure and composition, wherein all numbers in parentheses represent coverage in $g/m^2$:

| | |
|---|---|
| Layer 3 | Gelatin (5.3) |
| Layer 2 | Gelatin (3.7) - Spectrally red sensitized silver halide [silver coverage (1.6)]<br>- Spectral sensitizing dye A (.30)<br>- Spectral sensitizing dye B (.52)<br>- Cyan dye forming coupler (.84) |
| Layer 1 | Gelatin (2.6) - Grey colloidal silver (.32)<br>Transparent Film Support |

Sensitizing dye A:

Anhydro-5,6-dichloro-1-ethyl-3-(3-sulfobutyl)-3'-(3-sulfopropyl)-4',5'-benzobenzimidazolothiacarbocyanine hydroxide Sensitizing dye B:

Anhydro-5,5'-dichloro-9-ethyl-3,3'-bis(3-sulfopropyl) thiacarbocyanine hydroxide Cyan dye forming coupler: 1-Hydroxy-2-[4-(2,4-di-tert-pentylphenoxy)butyl]naphthamide.

Six additional photographic elements were prepared, which were identical to the control described above, except that in each a bleach accelerator precursor identified in Table 2, below, was incorporated in Layer 1 at a coverage of $0.1 g/m^2$.

The compounds were introduced into the coating composition by a method exemplified by the following procedure for the incorporation of Precursor 1:

A mixture consisting of 6 g of Precursor 1, 16 ml of a 6.7% TX-200 surfactant solution (available from ROHM & HAAS Company, Philadelphia), 130 g distilled water, and 250 ml of 2 mm ceramic ZrO beads was shaken for 3 hours on a SWECO milling machine (SWECO, Inc., Florence, Ky.). Following the subsequent addition of 48 g of a 12.5% aqueous gelatin solution and the removal of the ceramic beads by filtration through a coarse silk bag, a milky-white dispersion was obtained.

Separate portions of each of the so prepared photographic elements were sensitometrically exposed and then treated in separate conventional color processes including a ferric EDTA bleach (Process A) and a persulfate bleach (Process B), respectively.

| Process A: | | |
|---|---|---|
| Color development | 3 min | 15 sec |
| Stop | | 30 sec |
| Wash | | 30 sec |
| Bleach | 4 min | |
| Wash | 1 min | |
| Fix | 4 min | |
| Wash | 4 min | |
| Drying | | |

Composition of processing solutions:

| | | |
|---|---|---|
| Color Developer | | |
| Water | 800 | ml |
| Potassium carbonate (anh.) | 37.5 | g |
| Sodium sulfite (dessic.) | 4.25 | g |
| Potassium iodide | 1.2 | mg |
| Sodium bromide | 1.3 | g |
| Hydroxylamine sulfate | 2.0 | g |
| Diaminopropanol tetraacetic acid | 2.5 | g |
| 4-Amino-3-methyl-N—ethyl-N—β-hydroxyethylaniline sulfate | 4.75 | g |
| Potassium hydroxide (45%) | 0.65 | ml |
| Water to total of | 1 | liter |
| pH 10.0 | | |
| Stop | | |
| Water | 900 | ml |
| Conc. sulfuric acid | 10 | ml |
| Water to total of | 1 | liter |
| pH 0.9 | | |
| Bleach | | |
| Water | 600 | ml |
| Ammonium bromide | 150 | g |
| Ferric EDTA | 175 | ml |
| Glacial acetic acid | 10.5 | ml |
| Potassium nitrate | 41.2 | g |
| Water to total of | 2 | liters |
| pH 6.0 | | |
| Fix | | |
| Water | 800 | ml |
| Ammonium thiosulfate (58%) | 162 | ml |

-continued

| | | |
|---|---|---|
| EDTA, disodium salt | 1.25 | g |
| Sodium bisulfite (anhydr.) | 12.4 | g |
| Sodium hydroxide | 2.4 | g |
| Water to total of | 1 | liter |
| pH 6.5 | | |
| Process B | | |
| Color developer | 3 | min |
| Stop | 30 | sec |
| Bleach | 4 | min |
| Wash | 1 | min |
| Fix | 2 | min |
| Wash | 2 | min |
| Drying | | |

Composition of Processing Solutions

| | | |
|---|---|---|
| Color developer | | |
| Water | 850 | ml |
| Pentasodium salt of nitrilo-N,N,N—trimethylenephosphonic acid | 2.0 | ml |
| Sodium sulite (dessicated) | 2.0 | g |
| 3,5-dinitrobenzoic acid | 0.22 | g |
| Sodium bromide (anhydrous) | 1.20 | g |
| Sodium carbonate (anhydrous) | 25.6 | g |
| Sodium bicarbonate | 2.7 | g |
| 4-Amino-3-methyl-N—ethyl-N—β-(methanesulfonamido)ethylaniline sulfate hydrate | 4.0 | g |
| Water to total of | 1 | liter |
| pH 10.20 | | |
| Stop Bath: | | |
| Water | 900 | ml |
| Sulfuric acid (concentated) | 10 | ml |
| Water to total of | 1 | liter |
| pH 0.9 | | |
| Bleach | | |
| Sodium Hexametaphosphate | 2 | g |
| Sodium persulfate | 33 | g |
| Sodium chloride | 15 | g |
| Sodium dihydrogen phosphate | 7 | g |
| Phosphoric acid (85%) | 2.5 | ml |
| Gelatin | 0.3 | g |
| Water to total of | 1 | liter |
| Fix | | |
| Water | 700 | ml |
| Ammonium thiosulfate | 185 | ml |
| Sodium sulfite | 10 | g |
| Sodium bisulfite | 8.4 | g |
| Water to total of | 1 | liter |
| pH 6.5 | | |

In addition, portions of the elements were exposed and processed as described above, but omitting the bleach step. The amount of silver, in mg/m$^2$, was measured for each of the elements by X-ray fluorescence. From these figures, the amount of silver in the fully processed element is calculated as a percentage of the silver in the element processed without the bleach step. This is reported in Table 2, below, as % Ag remaining. This is a measure of the effectiveness of the bleach step.

The data in Table 2 reveal the superior effectiveness of out bleach accelerators in removing silver from color photographic elements that are processed through a multiplicity of different bleach compositions.

TABLE 2

| Element | Bleach Accelerator Precursor | Persulfate Bleach % Ag remaining (Process B) | Ferric EDTA Bleach % Ag remaining (Process A) |
|---|---|---|---|
| 1 | None | 85.2 | 8.1 |
| 2 | A | 45.5 | 5.2 |
| 3 | B | 24.8 | 5.2 |
| 4 | 1 | 0.0 | 3.5 |

TABLE 2-continued

| Element | Bleach Accelerator Precursor | Persulfate Bleach % Ag remaining (Process B) | Ferric EDTA Bleach % Ag remaining (Process A) |
|---|---|---|---|
| 5 | 3 | 58.0 | 1.0 |
| 6 | 4 | 13.7 | 5.6 |

EXAMPLE 2 Bleach-fix performance

Additional photographic elements prepared and exposed as described in Example 1 were processed as follows.

| Processing steps: | |
|---|---|
| Color development | 3 min 15 sec |
| Bleach-fix | 1 or 4 min |
| Wash | 4 min |
| Drying | |

Composition of processing solutions:

| | | |
|---|---|---|
| Color Developer | | |
| Water | 800 | ml |
| Potassium carbonate (anh.) | 37.5 | g |
| Sodium sulfite (dessic.) | 4.25 | g |
| Potassium iodide | 1.2 | mg |
| Sodium bromide | 1.3 | g |
| Hydroxylamine sulfate | 2.0 | g |
| Diaminopropanol tetra acetic acid | 2.5 | g |
| 4-Amino-3-methyl-N—ethyl-N—β-hydroxyethylaniline sulfate | 4.75 | g |
| Potassium hydroxide (45%) | 0.65 | ml |
| Water to total of | 1 | liter |
| pH 10.0 | | |
| Bleach-fix | | |
| Ammonium thiosulfate | 104 | g |
| Sodium bisulfite | 13 | g |
| $NH_4FeEDTA$ (.18M) | 65.6 | g |
| EDTA | 6.56 | g |
| Ammonium hydroxide (28%) | 27.9 | g |
| Water to total of | 1 | liter |
| pH 6.8 | | |

The results are shown in Table 3. The data in Table 3 demonstrate the superior effectiveness of the compounds of the invention in removing silver from photographic elements treated in a color photographic bleach-fix process.

TABLE 3

| Element | Bleach Accelerator Precursor | % silver remaining after bleach-fix treatment of 1 min | 4 min |
|---|---|---|---|
| 7 | None | 59.0 | 34.0 |
| 8 | A | 2.0 | 0 |
| 9 | B | 2.0 | 0 |
| 10 | 1 | 0.0 | 0 |
| 11 | 3 | 0.8 | 0 |
| 12 | 4 | 0.2 | 0 |

EXAMPLE 3

Photographic performance

Additional photographic elements were compared as described in Example 1, containing in Layer 1 the bleach accelerator precursors identified in Table 4 at a coverage of 0.053 g/m$^2$. In addition elements were prepared in which the bleach accelerator precursor was incorporated by the in-situ precipitation method disclosed in col. 6, lines 61–64, of U.S. Pat. No. 4,163,669, issued August 7, 1979. This is exemplified by the following procedure for incorporation of Precursor 1: 27 ml of 5 M $AgNO_3$ diluted with 25 ml distilled water were added via a micro pump to a stirred solution of 20 g (.136 mole) of Precursor 1, 32 g of a 12.5 % aqueous gelatin solution, and 196.5 ml distilled water at 40° C. The pH was maintained above 7 by the dropwise addition of aqueous $NH_4OH$ (28%). Five minutes after completion of the above procedure, 64 ml of a 12.5% aqueous gelatin solution were added, followed by dialyzing the resulting suspension for a period of 3 days.

These elements were sensitometrically exposed and then processed as in Example 1, Process A but omitting the stop and first wash steps and diluting the bleach to 1 liter instead of 2 liters.

The minimum densities ($D_{min}$), maximum densities ($D_{max}$), contrast (Gamma) and speed of the images produced in the photographic elements were measured and are as shown in Table 4. From the data in Table 4 it is apparent that the bleach accelerator precursor according to this invention had no adverse sensitometric effect on the photographic element.

TABLE 4

| Element | Bleach Accelerator | Method of Incorporation* | $D_{min}$ | $D_{max}$ | Gamma | Speed |
|---|---|---|---|---|---|---|
| 13 | None | — | .115 | 3.13 | 1.92 | 256 |
| 14 | A | X | .125 | 3.27 | 1.94 | 256 |
| 15 | A | Y | .224 | 2.16 | 0.86 | 254 |
| 16 | B | X | .132 | 3.20 | 1.90 | 255 |
| 17 | B | Y | .186 | 3.24 | 1.65 | 272 |
| 18 | 1 | X | .114 | 3.18 | 2.00 | 256 |
| 19 | 1 | Y | .128 | 3.13 | 1.89 | 256 |

*Methods of incorporation of bleach accelerators:
Method X: the method described in Example 1.
Method Y: the method described above.

EXAMPLE 4

Incubation

Photographic elements prepared as described in Example 3 were exposed, processed and evaluated as before after having been incubated for 3 and 7 days, respectively, at 50° C. and 80% RH. The results, in terms of minimum densities after incubation, are shown in Table 5. This data show the effective resistance of the photographic element containing a precursor or the invention to the formation of unwanted fog.

TABLE 5

| Element | Bleach Accelerator Precursor | Method of Incorporation | $D_{min}$ (3 days) | $D_{min}$ (7 days) |
|---|---|---|---|---|
| 20 | None | — | .56 | .95 |
| 21 | A | X | 1.0 | 1.35 |
| 22 | A | Y | complete fog | complete fog |
| 23 | B | X | 2.54 | 2.78 |
| 24 | B | Y | complete fog | complete fog |
| 25 | 1 | X | .61 | .88 |
| 26 | 1 | Y | .59 | — |

The invention has been described in detail with particular reference to preferred embodiments thereof, but it will be understood that variations and modifications can be effected within the spirit and scope of the invention.

What is claimed is:

1. A color photographic element comprising a support, a silver halide emulsion layer and, as a bleach accelerator precursor, a silver salt of a solubilized, non-primary amino thiol, the precursor having a solubility of less than 1 g/1 silver ion, a color developer solution comprising a pH of 10, a sulfite concentration of 4.25 g/1 and a bromide concentration of 1.3 g/1, and a solubility of greater than or equal to 1 g/1 silver ion in a bleach solution having a pH of 6 and a bromide ion concentration of 150 g/1, when held at 23° C. for five minutes in each of the solutions.

2. An element of claim 1 wherein the amino thiol is solubilized by the presence of one or more ether or thioether groups or by an additional non-primary amino group.

3. An element of claim 1 wherein the amino thiol has a structure selected from:

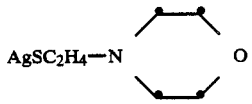

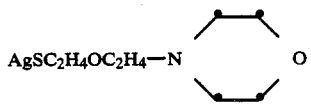

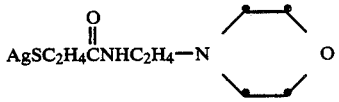

4. An element of claim 1 wherein the amino-thiol has a structure selected from:

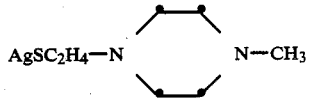

$AgSC_2H_4OC_2H_4N(CH_3)_2$
$AgSC_2H_4N(C_2H_4OCH_3)_2$

5. An element of claim 1 wherein the bleach accelerator precursor is contained in a photosensitive silver halide emulsion layer.

6. An element of claim 1 wherein the bleach accelerator precursor is contained in a radiation insensitive layer.

7. An element of claim 6 wherein the bleach accelerator precursor is contained in a radiation insensitive layer between the support and the lowermost radiation sensitive silver halide emulsion layer.

8. An element of claim 1 wherein the bleach accelerator precursor is present in the element at a concentration of from 0.01 to 10 $g/m_2$.

9. An element of claim 8 wherein the bleach accelerator precursor is present at a concentration of from 0.05 to 0.15 $g/m_2$.

10. An element of claim 1 further comprising a dye forming coupler.

11. An element of claim 1 wherein the bleach accelerator precursor is present as a ball milled dispersion.

12. In a process of bleaching silver from an exposed and developed photographic material by contacting the material with a bleaching agent, the improvement wherein there is present in the photographic material a bleach accelerator precursor which is a silver salt of a solubilized non-primary amino thiol, non-primary amino thiol, the precursor having a solubility of less than 1 g/1 silver ion, a color developer solution comprising a pH of 10, a sulfite concentration of 4.25 g/1 and a bromide concentration of 1.3 g/1, and a solubility of greater than or equal to 1 g/1 silver ion in a bleach solution having a pH of 6 and a bromide ion concentration of 150 g/1, when held at 23° C. for five minutes in each of the solutions.

13. A process of claim 12 wherein the bleaching agent is selected from persulfate and ferric ethylene diamine tetracetic acid bleaching agents.

14. A photographic element comprising a support, a spectrally sensitized silver halide emulsion layer and, as a bleach accelerator precursor, a ball-milled dispersion of a compound having the structure:

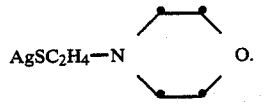

* * * * *